US011591121B2

(12) United States Patent
Rouzer et al.

(10) Patent No.: US 11,591,121 B2
(45) Date of Patent: Feb. 28, 2023

(54) COMPACT APPLICATING MACHINE

(71) Applicant: ILLINOIS TOOL WORKS INC., Glenview, IL (US)

(72) Inventors: James A. Rouzer, West Dundee, IL (US); Michael Burns, Elgin, IL (US); Kenneth J. Chess, Hinsdale, IL (US); Jacob L. Miller, Matteson, IL (US); Phillip E. Lullo, Tinley Park, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 334 days.

(21) Appl. No.: 15/993,091

(22) Filed: May 30, 2018

(65) Prior Publication Data

US 2018/0346162 A1 Dec. 6, 2018

Related U.S. Application Data

(60) Provisional application No. 62/513,794, filed on Jun. 1, 2017.

(51) Int. Cl.

| | |
|---|---|
| ***B65B 17/02*** | (2006.01) |
| ***B65B 41/16*** | (2006.01) |
| ***B65B 35/10*** | (2006.01) |
| ***B65B 59/02*** | (2006.01) |
| ***B65B 59/00*** | (2006.01) |

(52) U.S. Cl.

CPC ..... *B65B 17/02* (2013.01); *B65B 17/025* (2013.01); *B65B 35/10* (2013.01); *B65B 41/16* (2013.01); *B65B 59/001* (2019.05); *B65B 59/02* (2013.01)

(58) Field of Classification Search

CPC ..... B65B 21/00; B65B 17/02; B65B 1/06

USPC ..... 53/398, 474, 238, 43.4, 201, 48.1, 48.2, 53/48.3, 48.4, 48.5, 4, 41, 556

See application file for complete search history.

(56) References Cited

U.S. PATENT DOCUMENTS 3,032,944 A 5/1962 Hull et al.
4,169,343 A * 10/1979 McArdle ..... B65B 17/025 53/398

(Continued)

FOREIGN PATENT DOCUMENTS

CN 1197026 A 10/1998
CN 1439580 A 9/2003

(Continued)

OTHER PUBLICATIONS

European Patent Office, International Search Report, Form PCT/ISA/210, dated Aug. 20, 2018 (3 pages).

(Continued)

*Primary Examiner* — Andrew M Tecco
*Assistant Examiner* — Jacob A Smith
(74) *Attorney, Agent, or Firm* — Pauley Erickson & Swanson

(57) ABSTRACT

A machine for packaging multiple containers wherein a flexible carrier stock is fed across a jaw drum. A plurality of containers are moved through the machine whereby the carrier is subsequently positioned over the plurality of containers so that flexible carrier stock engages with two or more of the containers to form a package. The jaw drum and other operative components of the machine are preferably vertically adjustable to accommodate a range of container sizes and carrier configurations.

9 Claims, 10 Drawing Sheets

(56) References Cited

U.S. PATENT DOCUMENTS 4,354,333 A 10/1982 McArdle
4,357,186 A * 11/1982 Calvert ..... B29C 66/83423 156/73.1
4,392,337 A 7/1983 Hara
4,922,683 A * 5/1990 Connolly ..... B65B 9/14 53/291
5,069,016 A * 12/1991 Grossi ..... B65B 9/026 198/803.9
5,088,269 A * 2/1992 Thelen ..... B65B 17/025 53/398
5,233,811 A * 8/1993 Odum ..... B65B 17/025 53/48.4
6,170,225 B1 * 1/2001 Cervantes ..... B65B 61/06 53/48.4
6,508,047 B1 * 1/2003 Groppi ..... B65B 17/025 53/432
6,588,173 B1 * 7/2003 Moore ..... B65B 59/001 53/48.4
7,191,574 B2 * 3/2007 Malini ..... B65B 9/14 53/134.1
7,771,338 B2 * 8/2010 Wetsch ..... B31D 5/0052 493/464
8,112,970 B2 * 2/2012 Marco ..... B65B 17/025 53/398
2007/0000206 A1 * 1/2007 Berger ..... B65B 43/50 53/167
2007/0261373 A1 * 11/2007 Slovik ..... B65B 17/025 53/474
2008/0178559 A1 * 7/2008 DeFedericis ..... B65B 41/18 53/469
2008/0207421 A1 8/2008 Wetsch et al.
2009/0090085 A1 * 4/2009 Marco ..... B65B 21/24 53/398
2013/0036881 A1 * 2/2013 Slovik ..... B65B 59/001 83/13
2015/0291299 A1 10/2015 Yang et al.
2017/0113370 A1 4/2017 Slovik et al.

FOREIGN PATENT DOCUMENTS

CN 105059606 A 11/2015
CN 106395011 A 2/2017
EP 0 870 680 A1 10/1998
EP 0870680 A1 * 10/1998 ..... B65B 61/06

OTHER PUBLICATIONS

European Patent Office, Written Opinion of the International Search Report, Form PCT/ISA/237, dated Aug. 20, 2018 (6 pages).
European Patent Office, Communication Pursuant to Article 94(3) EPC for European Patent Application 18733082.4, dated Apr. 26, 2021 (4 pages).

* cited by examiner

COMPACT APPLICATING MACHINE

CROSS REFERENCE TO RELATED APPLICATION

This application claims the benefit of U.S. Provisional Application Ser. No. 62/513,794, filed on 1 Jun. 2017. The co-pending parent application is hereby incorporated by reference herein in its entirety and is made a part hereof, including but not limited to those portions which specifically appear hereinafter.

BACKGROUND OF THE INVENTION

Field of the Invention

This invention relates to a machine for unitizing a plurality of containers using a flexible container carrier.

Description of Prior Art

Container carriers connect two or more containers into a sturdy unitized package of containers. Carriers are generally planar arrays of rings, sometimes referred to as "six-pack carriers," typically formed from a thermoplastic sheet material. Carriers are applied to containers of various sizes and shapes along various points along the sidewall or under the chime of the container. A preferable machine would be capable of application of a container carrier to a wide range of container sizes.

Conventional carriers are arranged in aligned arrays of longitudinal rows and transverse ranks of container receiving apertures. A common arrangement is two rows of three ranks of longitudinally and transversely aligned container receiving apertures forming six total container receiving apertures and a "six-pack." Other common configurations include two rows of four ranks forming an eight container multipackage and three rows of four ranks forming a twelve container multipackage.

Conventional applicating machines generally include a circular jaw drum used to apply carriers to individual containers. The conventional jaw drum is typically fixed into position on the applicating machine and fed with a reel or box of a generally continuous container carriers. Such conventional applicating machines typically include an infeed conveyor for supplying a plurality of containers.

The string of carriers are then traditionally applied to the containers and, following application, cut into a desired package configuration. The resulting package is then fed into a turner-diverter that moves and/or rotates the package to a correct position for placement on a pallet or similar shipping unit.

Prior art applicating machines, systems and methods generally require several different versions or configurations of machines to accommodate different container carrier, package sizes and package configurations. Machines are traditionally a limitation on the range of container diameters, size of package or configuration of package that can be effectively packaged by a single system.

Finally, different machines or complex set-up procedures would also be required for containers having different sizes, heights and/or widths, resulting in different lengths, called "pitch" herein, between each adjacent container. As such, different machines and/or set-up procedures are traditionally required to bring the carrier to the correct position around the container.

SUMMARY OF THE INVENTION

A machine for packaging multiple container sizes, using multiple container carriers and/or multiple package sizes includes a carrier that moves through a jaw drum. The carrier is fed from a reel stand through the machine and then positioned around a perimeter of the jaw drum.

In operation, a vertically adjustable mount plate supports the jaw drum and other machine components. The jaw drum preferably applies carrier stock to containers in an intermittent manner wherein the jaw drum rotates and then briefly stops during application and then rotates and briefly stops to apply the next set of containers. Following application, the carrier stock is divided into a desired package size. Preferably, machines can be adjusted or adapted to place carriers on containers around the rim or chime ("rim-applied carriers" or RAC) or around a sidewall of containers ("sidewall-applied carriers or SAC).

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
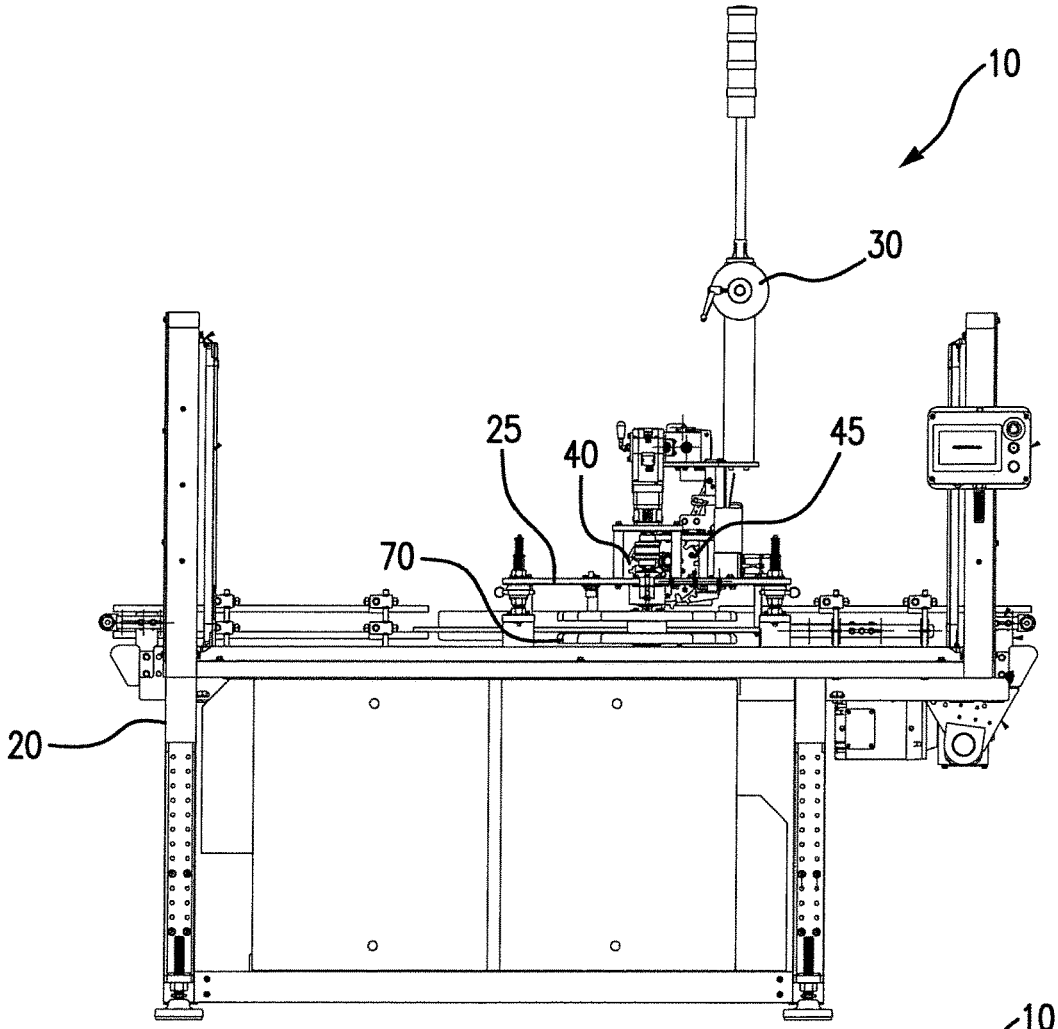
FIG. 1 is a side view of a machine for packaging containers according to one preferred embodiment of this invention.
Figure 2:
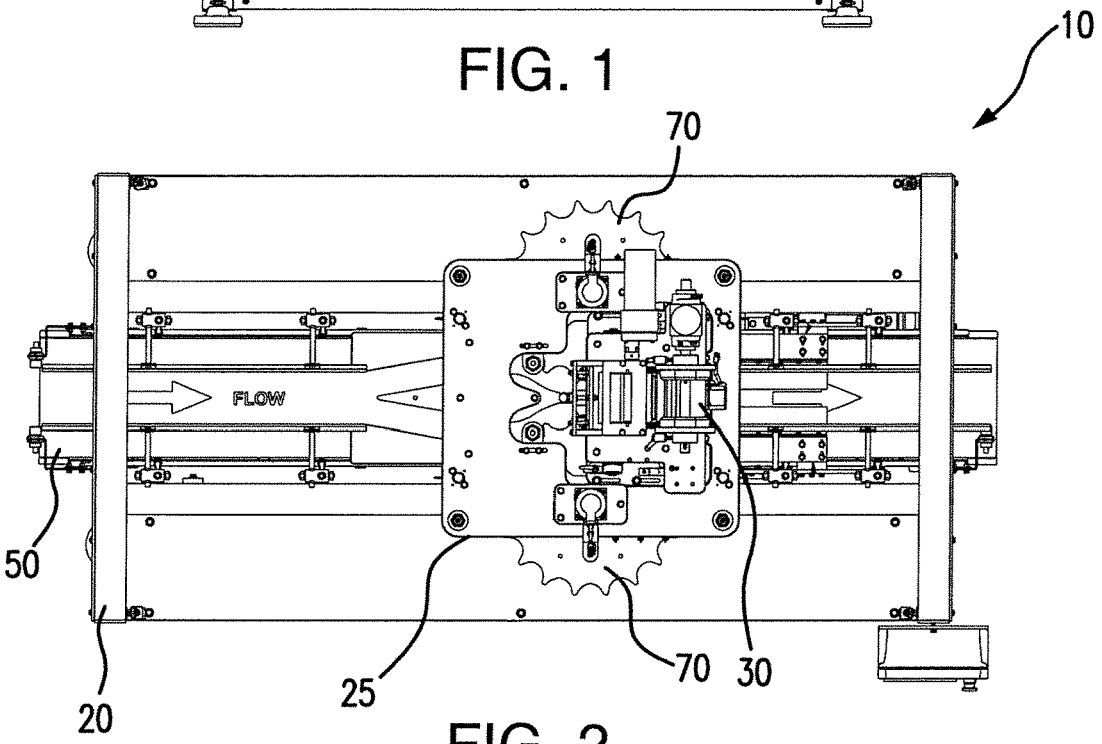
FIG. 2 is a top view of the machine for packaging containers shown in FIG. 1.
Figure 3:
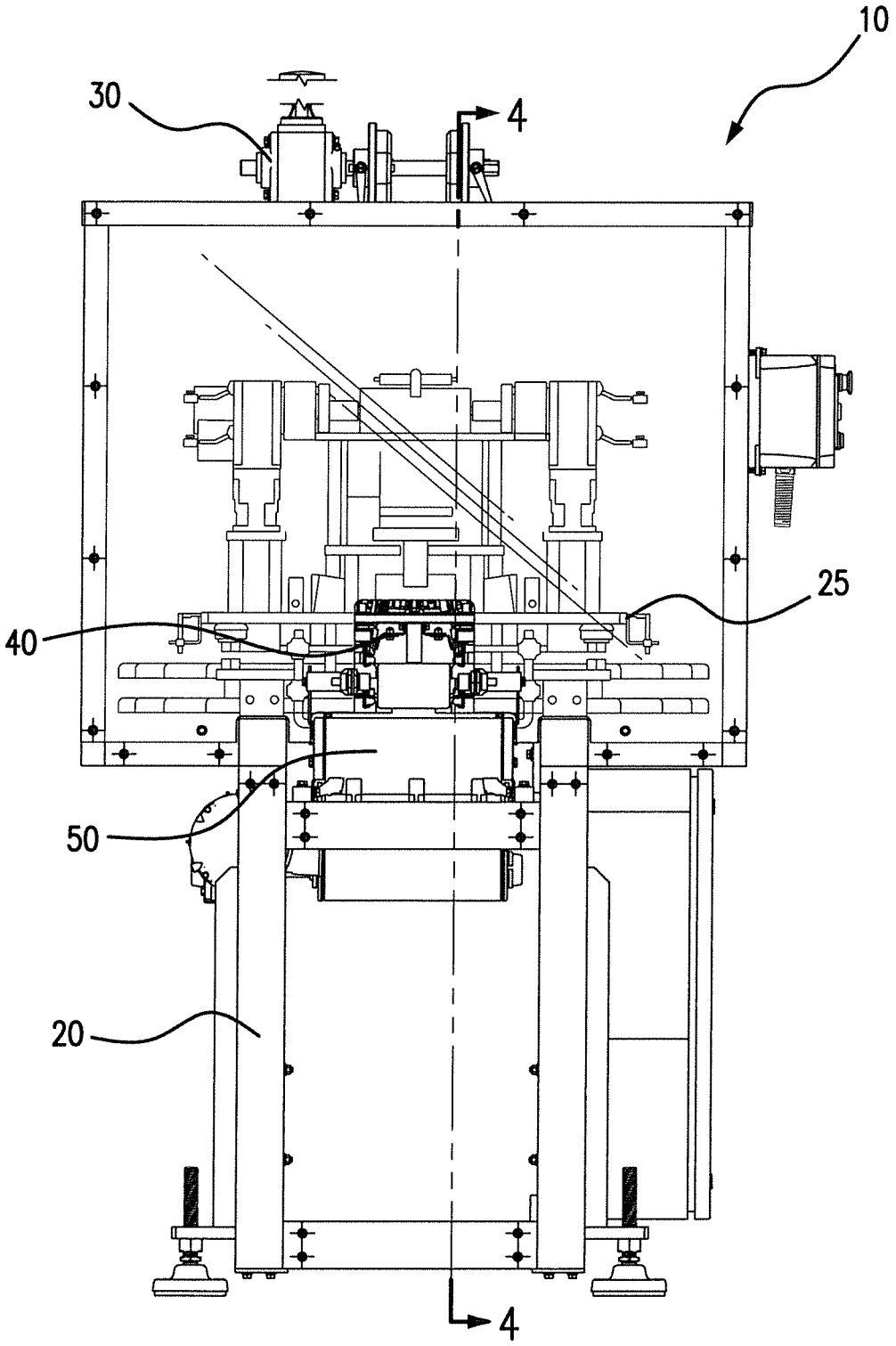
FIG. 3 is a front view of the machine for packaging containers shown in FIG. 1.

FIGS. 1-6 show a machine 10 for packaging multiple containers in a carrier according to one preferred embodiment of this invention. FIGS. 7-11 show a machine 100 for packaging multiple containers in a carrier according to another preferred embodiment of this invention. As shown schematically in FIG. 6, carrier stock 15 moves through machine 10, specifically from a reel stand 30 through a jaw drum 40, where the carrier stock 15 is applied to containers (not shown) and then separated into individual, unitized packages. According to one preferred embodiment of this invention, if a uniform group of like-sized containers having a different size requires packaging and/or if a different carrier is required, a separate machine is unnecessary as machine 10 may be quickly reconfigured, following various adjustments to machine 10, as described below.

Therefore, the machine 10 for packaging multiple containers in multiple size packages according to this invention permits the use of a single machine in combination with a variety of sizes of containers and/or sizes and configurations of carriers and/or packages. Traditional machines are typically fifteen or more feet long and six or more feet wide, therefore a reduction in the number and size of machines required in a packaging plant significantly reduces the required working floor space within the plant. In addition, quick and generally toolless set-up and changeover results in more efficient packaging operations.

The carrier stock 15 preferably moves through machine 10 from a reel stand 30 where carriers are dispersed in a continuous string of carrier stock 15 and ultimately to packages where each carrier is separated into a unitized package, each package containing a plurality of uniform containers. Alternatively, a generally continuous string of carrier stock may be dispensed from a fan-folded box. A typical configuration for a package is a "six-pack" containing two longitudinal rows of containers in three transverse ranks. Additional desired packages such as four-packs, eight packs and twelve packs may be unitized using machine 10 according to this invention, and such additional sizes of packages are limited only by the consumer market for such additional sizes.

The carrier (and carrier stock) is preferably constructed from a flexible plastic sheet, such as low-density polyethylene. The flexible plastic sheet is punched or otherwise formed into a plurality of container receiving apertures aligned in transverse ranks and at least two longitudinal rows to form a continuous sheet of carriers. The container receiving apertures are preferably oriented in a longitudinal direction with respect to carrier. The carrier may also include features such as a handle for holding carrier along either a side or a top of the package and/or a merchandising panel for displaying product and/or promotional information. Additionally, features such as tear tabs and perforations may be included in the carrier to ease removal of the containers from carrier.

According to one preferred embodiment of this invention, a machine 10 for packaging multiple containers includes moving carrier stock 15 through machine 10 from an integrated reel stand 30. The machine 10 includes a frame 20 and a vertically adjustable mount plate 25 positioned with respect to the frame 20. The mount plate 25 preferably accommodates one or more of the operable elements of the machine 10.

As shown in FIGS. 1-5, the reel stand 30 is preferably positioned on the mount plate 25. As described in more detail below, the reel stand 30 is adapted to feed the flexible carrier stock 15 through the machine and, ultimately to the jaw drum 40.

Figure 6:
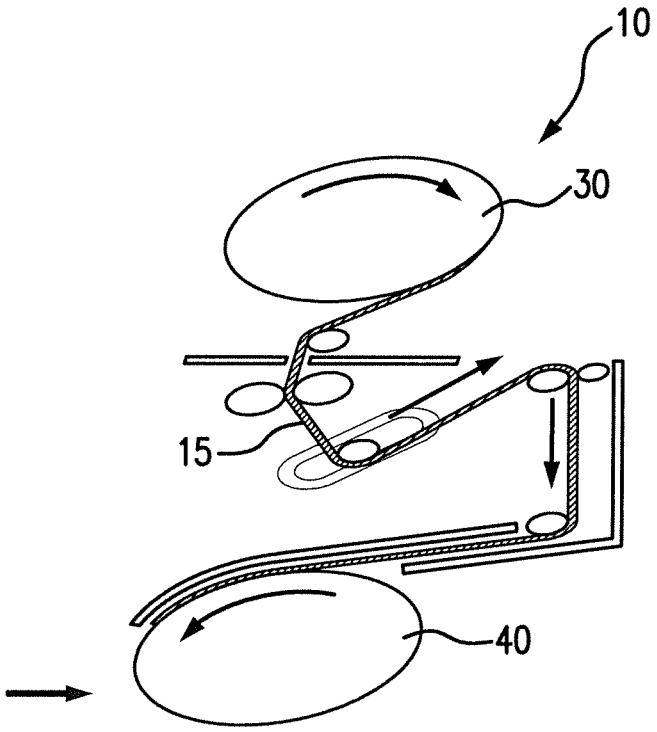
FIG. 6 shows a schematic of the carrier feed according to one preferred embodiment of this invention.
Figure 7:
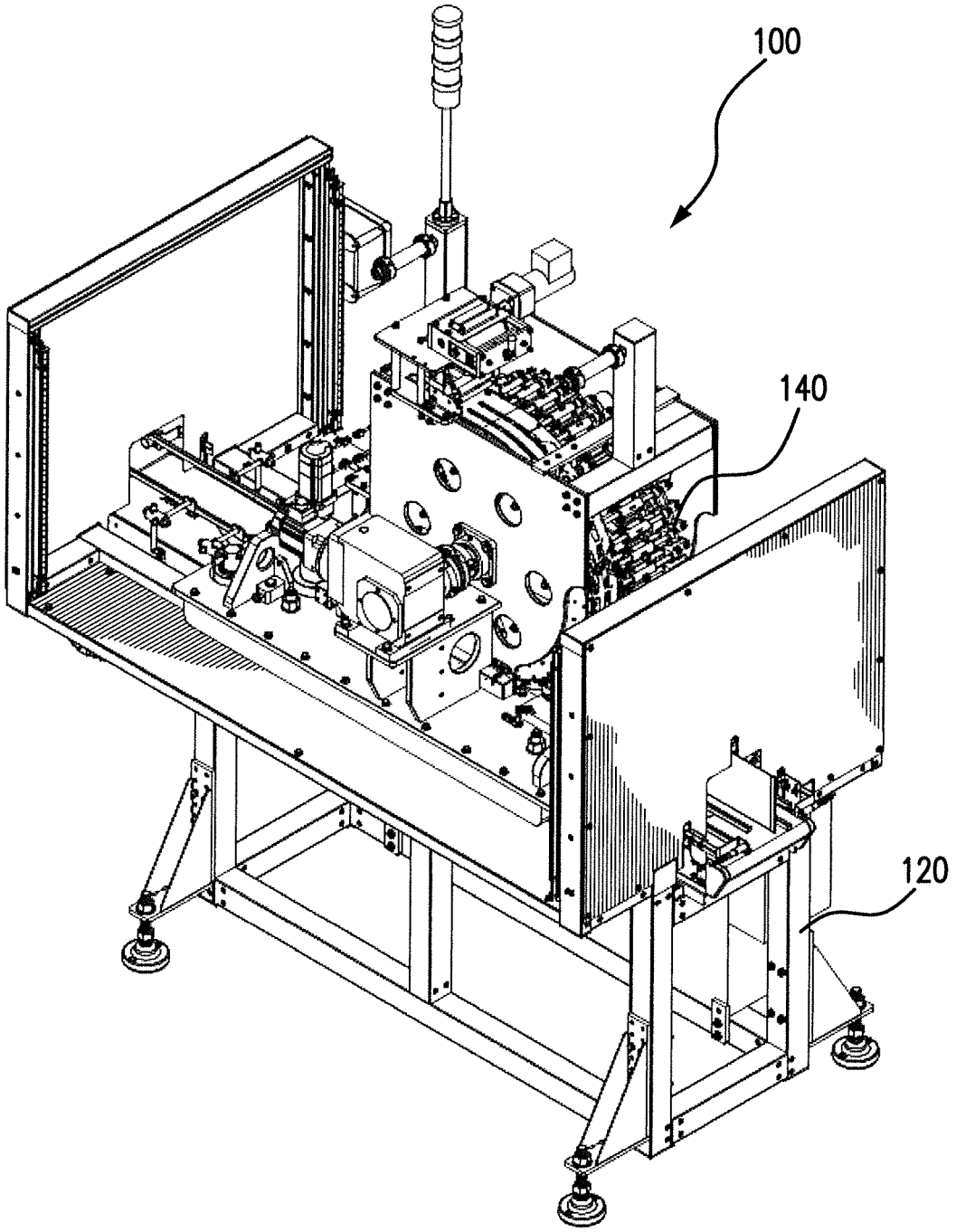
FIG. 7 is a top perspective view of a machine for packaging containers according to one preferred embodiment of this invention.
Figure 8:
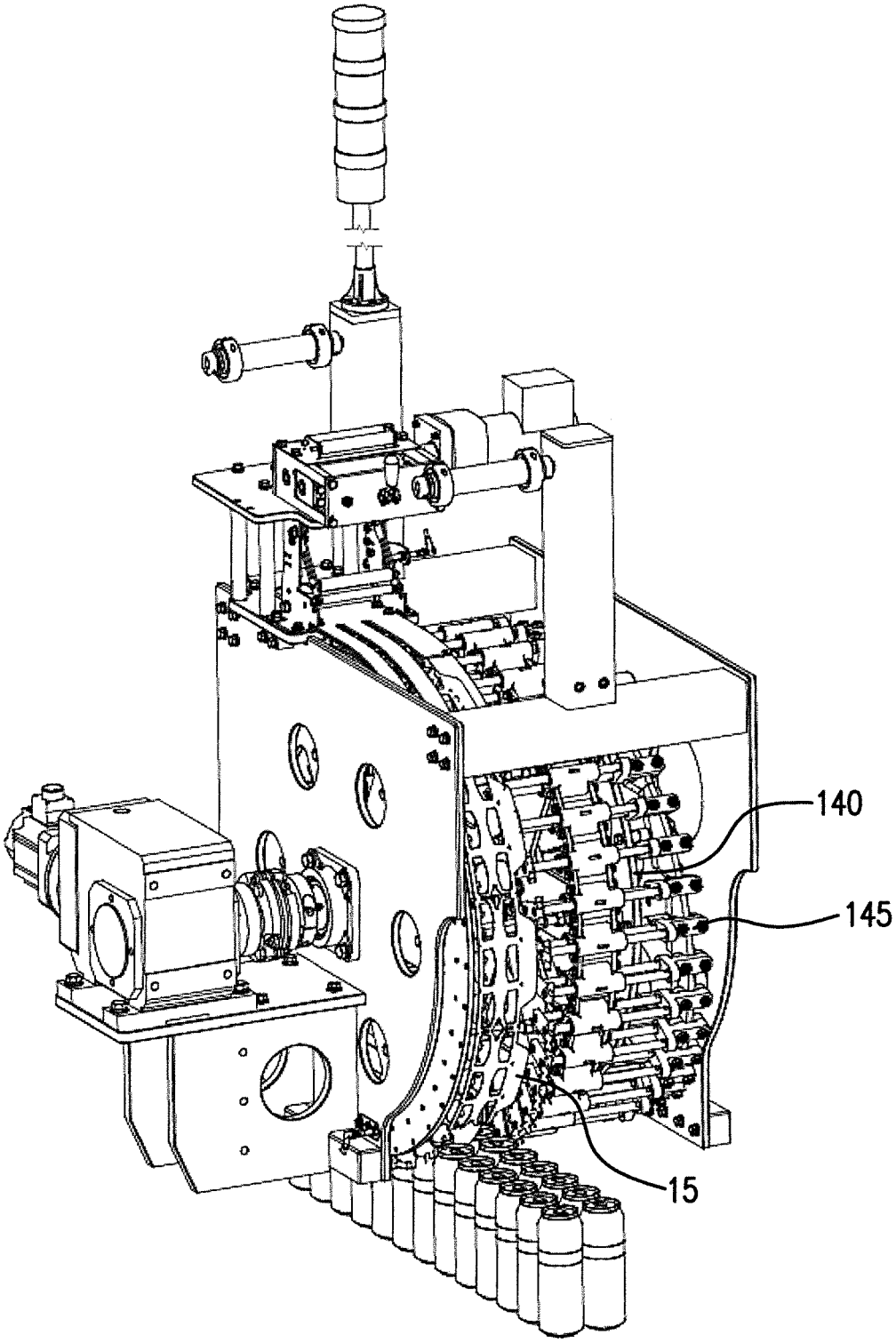
FIG. 8 is front perspective view of a drum portion of the machine shown in FIG. 7.
Figure 9:
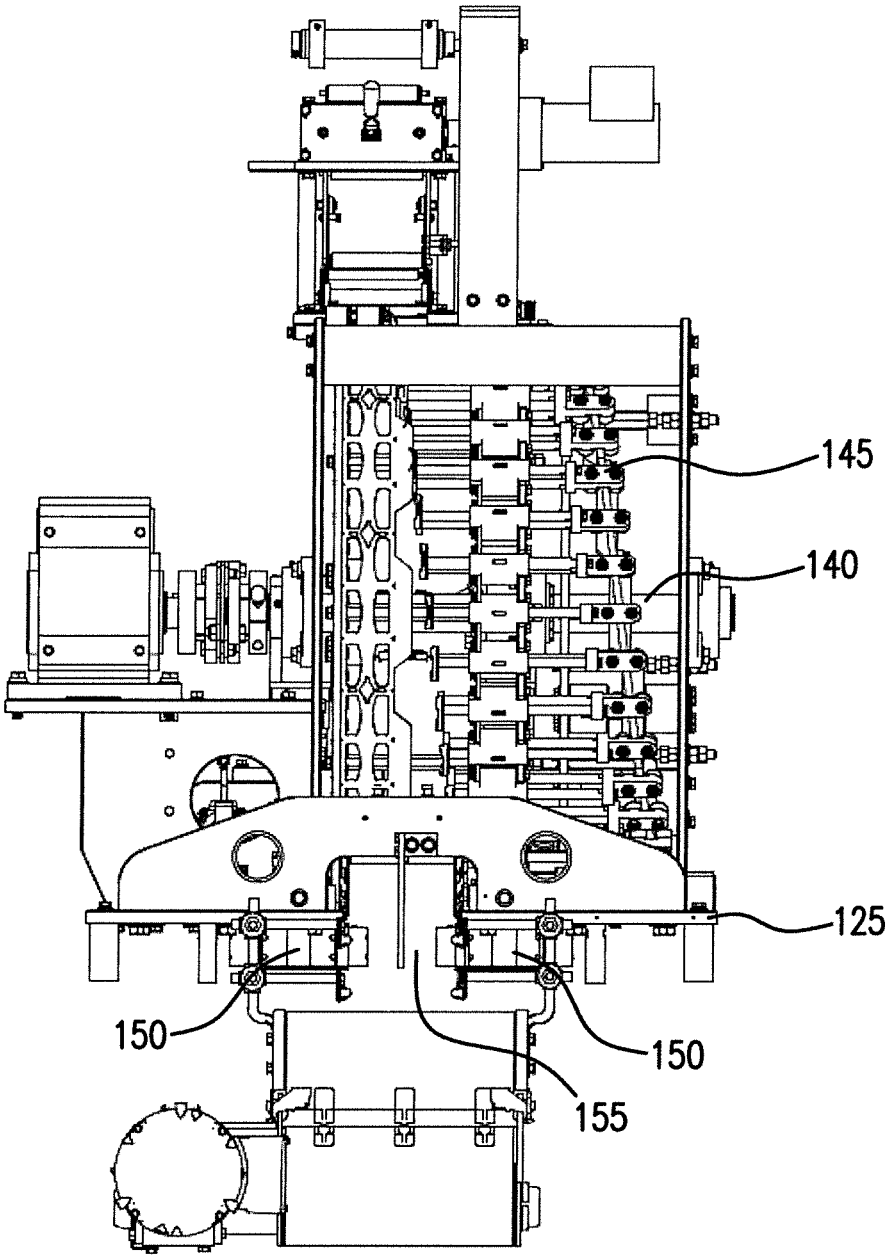
FIG. 9 is a rear view of the drum portion of the machine shown in FIG. 8.
Figure 10:
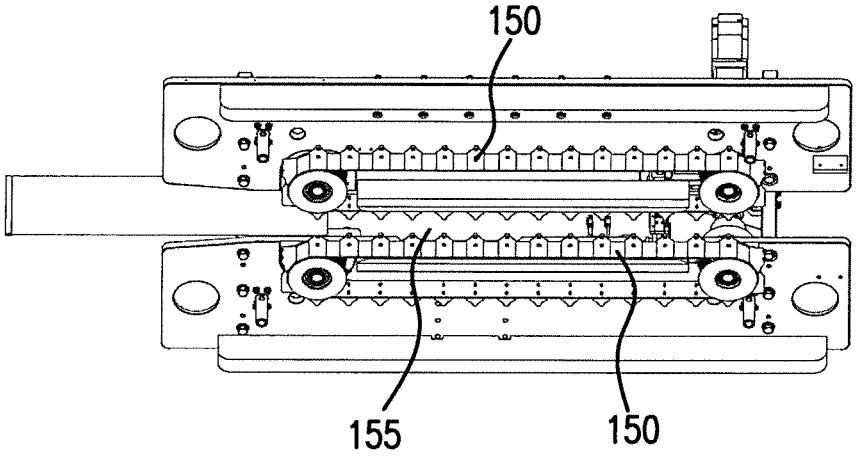
FIG. 10 is top perspective view of a feed mechanism of the machine shown in FIG. 7.

The jaw drum 40 is preferably additionally positioned on the mount plate 25. The jaw drum 40 is adapted to draw the flexible carrier stock 15 from the reel stand 30 and apply the flexible carrier stock 15 to the plurality of containers. FIG. 6 shows a schematic of the preferred operation of the machine 10 and the path of the carrier stock 15 from the reel stand 30 through additional pinch rollers and feed rollers and to the jaw drum 40.

According to a preferred embodiment of the invention, the mount plate 25, the reel stand 30 and the jaw drum 40 are simultaneously vertically adjustable with respect to the frame 20. In this manner, the machine 10 is capable of unitizing multiple sizes of containers, such as 12 ounce cans, 16 ounce cans and 19.2/20 ounce cans—which each may have a different height. As such, the mount plate 25 may be adjusted upward or downward to accommodate these different heights and various operative components of the machine 10 are moveable in a simultaneous manner. In addition, adjustment of the mount plate 25 in this manner may enable the carrier stock 15 to be applied to the rim or chime of the container ("rim applied carriers" or RAC) or to the sidewall of the container ("sidewall applied carriers" or SAC).

According to a preferred embodiment of this invention, a conveyor 50 is positioned below the jaw drum 40 to convey the plurality of containers through the machine 10. The conveyor 50 may comprise a flexible elastomeric belt, a rigid segmented belt, or any other suitable conveying mechanism suitable for use with beverage and/or food containers.

Figure 4:
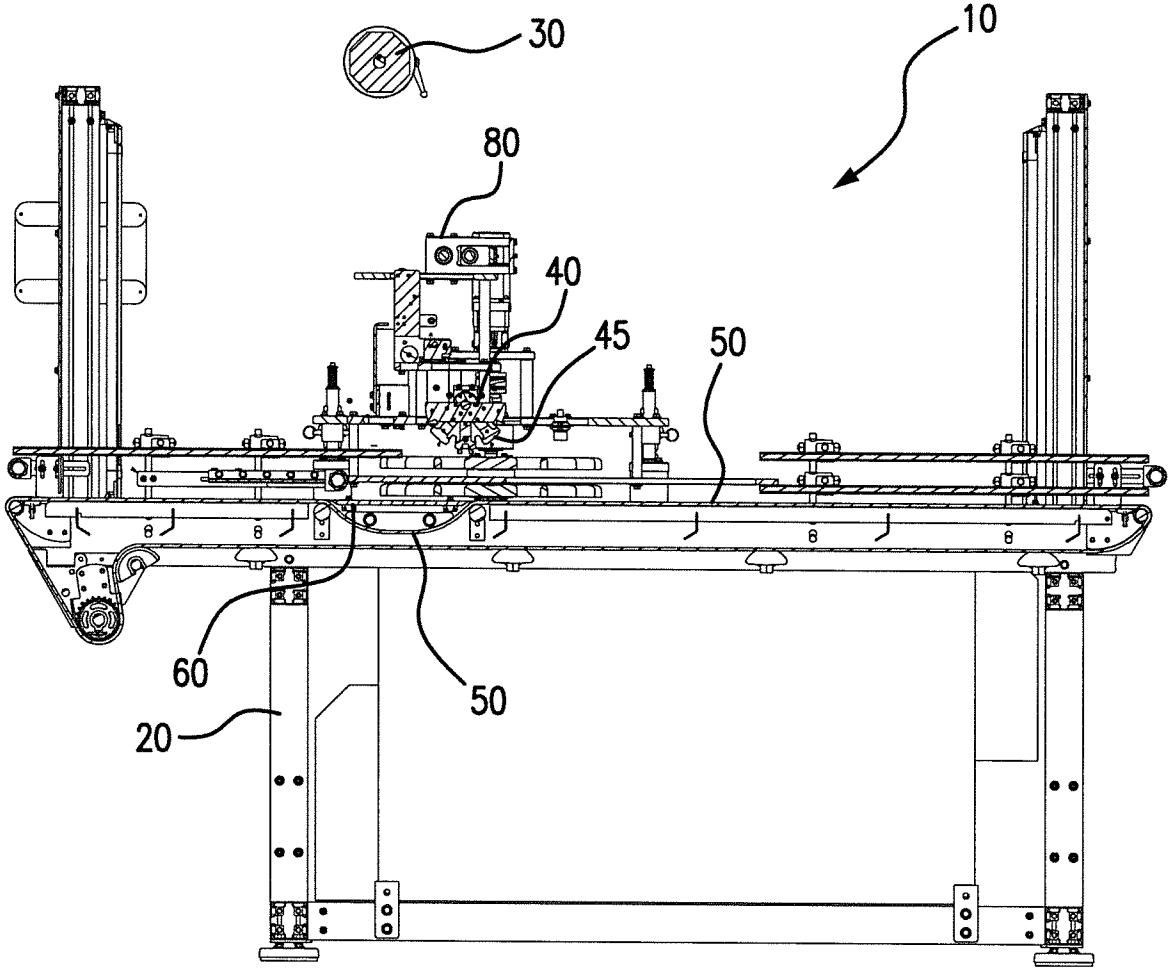
FIG. 4 is a side cutaway view of the machine for packaging containers taken along section 4-4 of FIG. 3.
Figure 5:
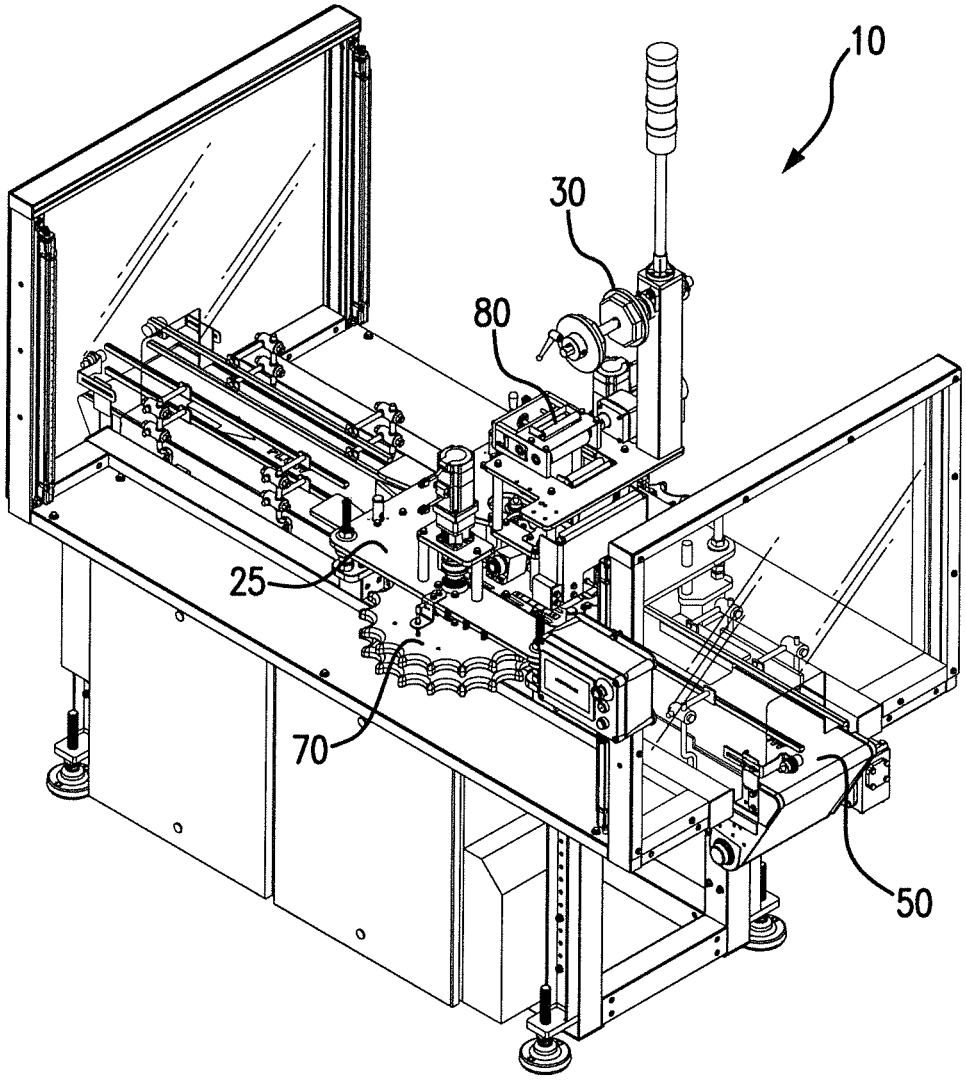
FIG. 5 is a top perspective view of the machine for packaging containers shown in FIG. 1.

In addition, as best shown in the FIG. 4, a dead plate 60 is preferably positioned over a top of the conveyor 50 or within a space between adjacent conveyors 50 directly below the jaw drum 40 in an area where the carrier 15 is applied to the containers. The conveyor 50 preferably extends in a generally coplanar position relative to an infeed and an outfeed of the dead plate 60 and beneath a length of the dead plate 60. The dead plate 60 preferably comprises a rigid sheet or plate having a smooth upper surface permitting the containers to slide along as the carrier 15 is positioned over the containers. In one preferred embodiment of the invention, the dead plate 60 is constructed of plastic having a low friction coating such as TEFLON®.

The machine 10 may further include a jaw drum 40 having a pair of jaw plates 45 for engaging the flexible carrier stock 15. The jaw plates are preferably generally round and each include a plurality of jaws located radially about each jaw plate 45 of the jaw drum 40. When the two jaw plates 45 are assembled, the resulting jaw drum 40 includes a plurality of adjacent jaw pairs located radially around the jaw drum 40. The two jaw plates 45 are preferably canted at an angle with respect to the vertical and each other. As a result of the canted relationship between the jaw plates 45, the relative distance between the jaw pairs change as the jaw drum 40 is rotated through a full 360° rotation. Opposing jaw pairs on respective jaw plates 45 preferably engage the carrier stock 15 and as the carrier stock 15 is rotated around the jaw drum 40, the canted jaw plates 45 stretch the carrier stock for engagement with the containers passing through the conveyor 50 and dead plate 60.

The jaw drum 40 thereby transports carrier stock 15 from the reel stand 30 to the plurality of containers which flow through jaw drum 40. A plurality of jaw pairs 45, one opposing jaw on each opposing jaw plate 45, are preferably equally spaced around a perimeter of jaw drum 40. Radial positions of jaw pairs 45 around the perimeter of jaw drum 40 are preferably permanently fixed.

Each jaw pair is configured to grip carrier stock 15 through each transverse pair of container receiving apertures in carrier stock 15. The circumferential spacing between adjacent jaw pairs is preferably approximately equal to a pitch of carrier, i.e., the distance between adjacent centers of container receiving openings. Carrier stock 15 is engaged with the jaw pairs of the jaw drum 40 immediately prior to application to containers.

As such, jaw drum 40 is adapted to draw the flexible carrier stock 15 from the reel stand 30 and apply the flexible carrier stock 15 to the plurality of containers. Unlike traditional high-speed application equipment wherein the jaw drum 40 continuously rotates to apply carrier stock 15 in a continuous manner to the respective containers, the subject jaw drum 40 operates in an intermittent rotational manner. Although still generally continuous, the jaw drum 40 according to the present device, stops and starts at each rotational jaw pair to apply the carrier stock 15 to the respective containers—typically one pair of containers at a time. In this manner, the jaw drum 40 rotates a distance between jaw pairs, stops momentarily, and then rotates again to the next respective jaw pair. As a result, the machine according to this invention will typically operate at lower speeds than conventional high-speed equipment. However, the subject machine may be capable of applying carrier to 300 containers per minute.

Following application to containers, carrier stock 15 is divided into individual carriers resulting in individually unitized packages of a desired size. This division may be accomplished by a pair of knives positioned on each side of the carrier stock that is inserted between the containers of a desired package size.

The machine 10 preferably additionally includes a conveyor 50 for conveying the containers longitudinally into and through the frame 20 of the machine 10, in preferably two longitudinal rows. According to a preferred embodiment of this invention, a pair of star wheels 70 are positioned, one on each side of the jaw drum 40 to accept containers from the conveyor 50. The star wheels 70 are preferably located on the mount plate 25, together with other operative components of the machine 10 described above.

The star wheels 70 serve to locate the containers for proper application of carrier stock 15 to such containers. The plurality of containers moves through machine 10 and each container is spaced apart from an adjacent container by the star wheels 70 as they pass across the dead plate 60 and beneath the jaw drum 40. The spacing between adjacent containers as they enter the machine 10 depends upon the relative sizing and configuration of the star wheels 70 which may be exchangeable and/or sized to accommodate the largest diameter container to be used in machine 10. The star wheels 70 may be replaceable with substitute star wheels having a different thickness or different surface geometry, such as to accommodate non-conventional container shapes, such as contoured cans. As discussed in more detail below, carrier stock 15 is subsequently positioned over the plurality of containers whereby each container receiving aperture engages with one of the containers to form a package having a predetermined number of containers.

As the jaw pairs move with the rotation of the jaw drum 40 by operation of the angled spacing of the jaw plates 45, from a closed position to an open position, container receiving apertures within carrier stock 15 stretch to accommodate a container. The carrier stock 15 in a stretched condition is positioned over a plurality of containers, preferably one adjacent pair of containers at a time, so that each container receiving aperture engages with one container. Upon engagement with the containers, the carrier stock 15 is released from the jaw pair and grips a perimeter of container, either around a chime in a rim-applied carrier (RAC) configuration or around a sidewall in a sidewall-applied carrier (SAC) configuration.

As shown schematically in FIG. 6, the carrier stock 15 preferably extends from the reel stand 30 through one or more pairs of pinch rollers 80. One or more additional rollers may further operate to measure and/or maintain a relative tension in carrier stock 15 as it is pulled from the reel stand and advanced to jaw drum 40.

As described above, the machine 10 is particularly adaptable to package containers with a rim-applied carrier stock 15 configuration using a jaw drum 40 having canted jaw plates 45 as described. However, such a jaw drum 40 arrangement may not be optimal for applying carrier stock 15 further down on a container along a sidewall. As a result, according to one preferred embodiment of the invention, a machine 100 is shown in FIGS. 7-11 and is particularly adapted for use with side-applied (SAC) carrier stock.

FIGS. 7-11 show various views of a machine 100 that applies carrier stock 15 along a sidewall of a container and preferably within a middle third of a container body. Such arrangement called sidewall applied carrier or SAC has advantages in certain applications. For instance, a SAC configuration may not require a handle, may be useful for taller containers such as 16 ounce and/or 19.2 ounce cans and may utilize carrier stock 15 having a smaller gauge than RAC carriers. The machine 100 as shown preferably includes a jaw drum 140 that includes a set of fixed jaws and a set a moveable jaws 145 whereby the moveable jaws 145 are cammed to open and close the moveable jaws 145 relative to the fixed jaws as the jaw drum 140 rotates. In this manner, carrier stock 15 may be spread open and pushed down over the sidewall of a container before being released onto a plurality of containers creating a desired package.

Figure 11:
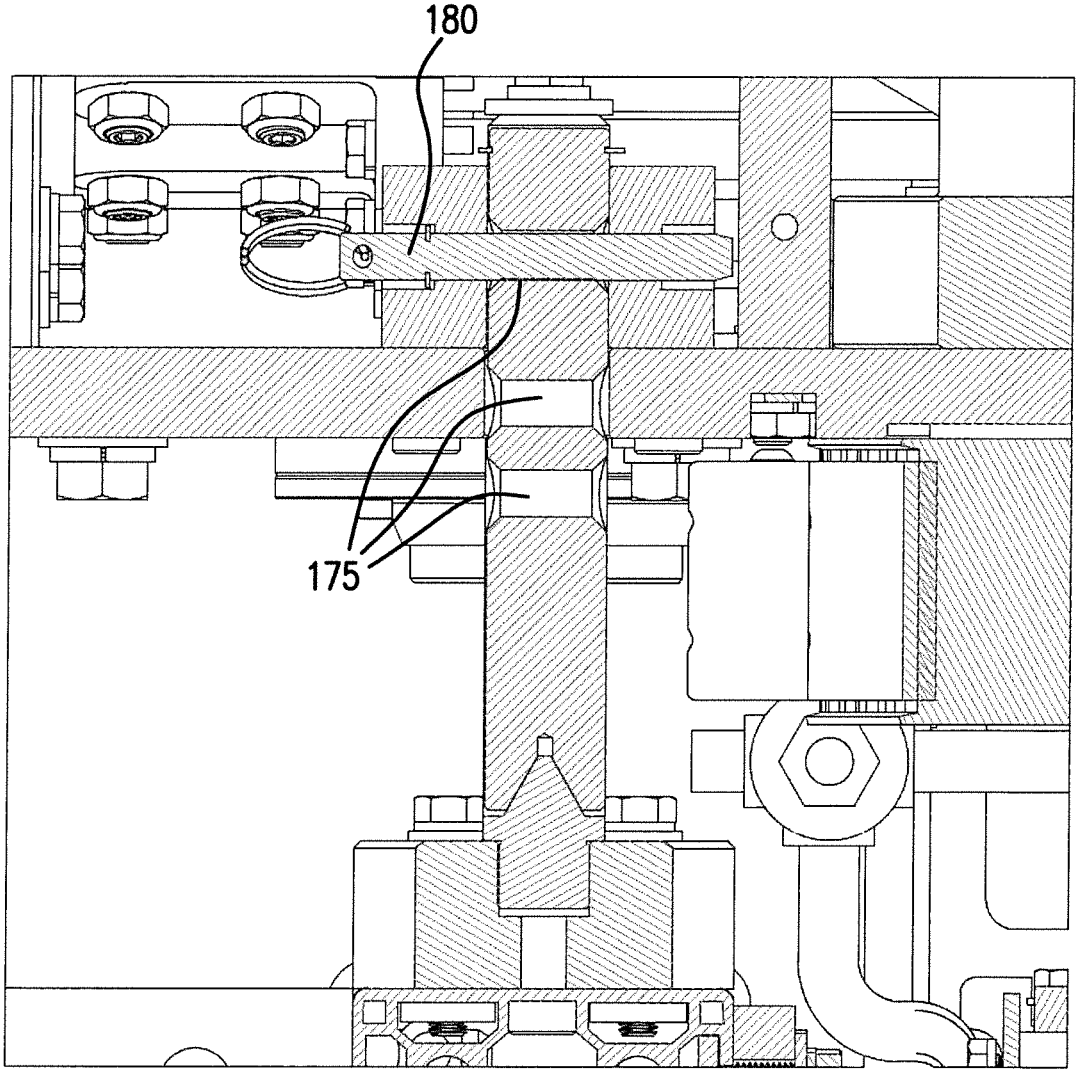
FIG. 11 is a side cutaway view of an adjustment mechanism of the machine shown in FIG. 7.

The jaw drum 140 is preferably positioned on a vertically adjustable mount plate 125. According to a preferred embodiment, the mount plate 125 and the jaw drum 140 are simultaneously vertically adjustable with respect to the frame 120. In this manner, the machine 100 is capable of unitizing multiple sizes of containers, such as 12 ounce cans, 16 ounce cans and 19.2 ounce cans—which each may have a different height. As such, the mount plate 125 may be adjusted upward or downward relative to the supply of containers to accommodate these different heights and various operative components of the machine 100 are moveable in a simultaneous manner. FIG. 11 shows an embodiment of an adjustment mechanism including adjustment apertures 175 and a pin 180 for fixing a position of the mount plate relative to the supply of containers. As shown, a highest position of aperture 175 accommodates 12 ounce cans, the middle position aperture 175 accommodates 16 ounce cans and the bottom position aperture 175 accommodates 19.2 ounce cans.

A supply of containers is preferably provided to an inlet side of the machine 100 along an inlet conveyor (not shown) or a similar conveyance device. The containers are fed below the jaw drum 140 where carrier stock 15 is applied and packaged containers are then directed to an outlet side of the machine 100.

According to one embodiment, a reel stand 30 may not be integrated with the machine 100 but instead may be positioned off-board in linear alignment with the machine 100. In this manner, a supply of carrier stock 15 may be provided from either the inlet side of the machine 100 or the outlet side of the machine 100 depending on where production space is available.

The supply of containers are fed through the jaw drum 140 preferably using a conveyor 150 having a plurality of pockets 155 to positively engage each container (or pair of containers) as it passes below the jaw drum 140. Each container is maintained in position within a respective pocket 155 of the conveyor 150 so that the jaw drum 140 may apply the flexible carrier stock 15 to the plurality of containers. As shown in the drawings, the conveyor 150 may be vertically oriented with lugs forming pockets 155 to move containers through the jaw drum 140. There may additionally be a horizontal moving conveyor below the containers or, alternatively, simply a smooth stationary sliding surface may be positioned beneath the containers as they move through the jaw drum 140.

Like the RAC version of the machine 10, the subject jaw drum 140 preferably operates in an intermittent rotational manner. Although still generally continuous, the jaw drum 140 according to the present device, stops and starts at each rotational jaw pair to apply the carrier stock 15 to the respective containers—typically one pair of containers at a time. In this manner, the jaw drum 140 rotates a distance between jaw pairs, stops momentarily, and then rotates again to the next respective jaw pair. During application, pairs of containers are maintained in positive engagement with respective pockets 155 of the conveyor 150.

Following application to containers, carrier stock 15 is divided into individual carriers resulting in individually unitized packages of a desired size. This division may be accomplished by a knife or knives positioned on at least one side of the carrier stock that is inserted between the containers of a desired package size. According to one embodiment, a single blade alternates between sides of the outlet as it linearly cuts each respective package. During such cutoff, the pockets 155 of the conveyor 150 continue to maintain positive engagement of each pair of containers in the package until the finished package is directed to the outlet and an outlet conveyor and/or a turner/diverter (not shown).

As described above, one or more operative components of machine 10, 100 are preferably adjustable to permit packaging of containers having different sizes, such as heights and diameters and carriers having different sizes. In each of these different applications, multiple components of machine 10, 100 may be adjusted, replaced and/or interchanged to permit application of carrier stock 15 to containers.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

The invention claimed is:

1. A machine for packaging a plurality of containers into packages using flexible carrier stock, the machine comprising:

a frame;

a vertically adjustable mount plate positioned with respect to the frame;

a vertically adjustable reel stand and a pinch roller positioned on the mount plate, the reel stand adapted to hold a reel of flexible carrier stock and supply the flexible carrier stock to the plurality of containers and the pinch roller adapted to feed the flexible carrier stock; and a jaw drum positioned on the mount plate, the jaw drum adapted to draw the flexible carrier stock sourced from the reel stand and apply the flexible carrier stock to the plurality of containers, wherein the mount plate, the reel stand and the jaw drum are simultaneously vertically adjustable with respect to the frame.

2. The machine of claim 1 further comprising:

a dead plate positioned below the jaw drum.

3. The machine of claim 2 further comprising:

a conveyor positioned below the jaw drum, the conveyor extending in a generally coplanar position relative to an infeed and an outfeed of the dead plate and beneath a length of the dead plate.

4. The machine of claim 1 wherein the jaw drum comprises a pair of angled jaw plates for engaging the flexible carrier stock.

5. The machine of claim 1 wherein the reel stand and the jaw drum are in general vertical alignment relative to each other.

6. The machine of claim 1 further comprising:

one or more star wheels positioned on the mount plate relative to the jaw drum.

7. The machine of claim 1 wherein the jaw drum is adapted to rotate intermittently as carrier stock is applied to the containers.

8. The machine of claim 1 further comprising a generally continuous conveyor extending through the machine to convey two rows of containers wherein the mount plate is positioned over the conveyor in a direct vicinity of the jaw drum.

9. A machine for packaging a plurality of containers into packages using flexible carrier stock, the machine comprising:

a frame;

a vertically adjustable mount plate positioned with respect to the frame;

a vertically adjustable reel stand and a pinch roller positioned on the mount plate, the reel stand adapted to hold a reel of flexible carrier stock and supply the flexible carrier stock to the plurality of containers and the pinch roller adapted to feed the flexible carrier stock; and a jaw drum positioned on the mount plate, the jaw drum adapted to draw the flexible carrier stock from the reel stand and apply the flexible carrier stock to the plurality of containers, wherein the mount plate, the reel stand and the jaw drum are simultaneously vertically adjustable with respect to the frame.

* * * * *